United States Patent [19]

Jones et al.

[11] 4,222,488

[45] Sep. 16, 1980

[54] METHODS AND APPARATUS FOR SORTING ARTICLES

[75] Inventors: Jerry R. Jones, Greenfield; Ralph F. Stephens, Carmel, both of Ind.

[73] Assignee: Western Electric Company, Inc., New York, N.Y.

[21] Appl. No.: 68,302

[22] Filed: Aug. 20, 1979

[51] Int. Cl.[3] ..... B07C 5/00

[52] U.S. Cl. ..... 209/583; 209/587; 209/657; 209/911

[58] Field of Search ..... 209/911, 653, 657, 587, 209/571, 573, 574, 575, 572, 583; 221/289, 290, 292, 293, 294, 295

[56] References Cited

U.S. PATENT DOCUMENTS

| | | | |
|---|---|---|---|
| 2,364,832 | 12/1944 | Weckerly | 209/911 X |
| 2,992,730 | 7/1961 | Rayburn et al. | 209/911 X |
| 3,080,054 | 3/1963 | Dickison et al. | 209/911 X |
| 3,153,485 | 10/1964 | West | 209/911 X |
| 3,215,241 | 11/1965 | Haefele et al. | 209/575 X |
| 3,283,896 | 11/1966 | Jirik et al. . | |
| 3,327,847 | 6/1967 | Lockshaw . | |
| 3,480,140 | 11/1969 | Unkefer | 209/575 |
| 3,547,265 | 12/1970 | Braun . | |
| 3,575,291 | 4/1971 | Hurst | 209/573 |
| 4,129,940 | 12/1978 | Mitchell . | |

OTHER PUBLICATIONS

Bailey et al., *Diode Test Handles for Nonmagnetic Leaded Diodes*, Western Electric Technical Digest, No. 51, Jul. 1978, p. 3.

*Primary Examiner*—Allen N. Knowles
*Attorney, Agent, or Firm*—J. L. Landis

[57] ABSTRACT

Articles, such as rectangular thin film circuits (11), are sorted by advancing a row of the articles along a chute (20). The leading article (11-A) in the row is stopped in a test position with a releasable stop member (40), after which the lead article is tested for a characteristic, such as by a photoelectric detector (41) that scans a circuit and detects the absence or presence of an ink mark (16) previously applied to a defective circuit. If the article is of a first type (good circuit), the stop 40 is released so that the lead article advances further to a receiver (30). If the article is of a second type (bad circuit), a mechanism (45) is operated to eject the article transversely from the chute (arrow C). Preferably, an article to be ejected is pivoted (arrow F) about a transverse axis (F) to disengage the trailing edge (48) of the lead article (11-A) from the leading edge (49) of a following article (11-B) prior to ejection from the chute.

17 Claims, 8 Drawing Figures

METHODS AND APPARATUS FOR SORTING ARTICLES

TECHNICAL FIELD

This application relates generally to methods and apparatus for sorting a succession of articles into groups in accordance with a detectable characteristic of the articles, and particularly to sorting electrical circuits into good and bad groups in accordance with the results of a test. In a specific example, the invention relates to automatically sorting rectangular thin film circuits into good and bad groups in accordance with the results of a test, and for loading the good circuits into a receiver, such as a tray.

BACKGROUND OF THE INVENTION

In the manufacture of certain types of thin-film circuits, also known as hybrid integrated circuits (HIC's), circuit patterns are deposited on one surface of a thin relatively fragile ceramic substrate. Initially, relatively large numbers of identical circuits are deposited at discrete areas on a large-area substrate, such as twenty circuits in one example, after which the large substrate is scribed and broken, and border areas are removed, to form the individual rectangular circuits.

In the past, it has been customary to test the individual circuit areas while still on the large substrate, prior to the scribing and breaking operation, and to mark the bad circuit areas in a later detectable way, as by applying a dot of black ink to the bad circuit areas. Then, after scribing and breaking by hand, the circuits have been inspected manually and the good circuits loaded into a receiver, such as a tray having individual slots for receiving the good circuits, for storage and transport to subsequent processing operations wherein the thin film circuits are fabricated with other components into complete circuit assemblies such as used in telephone sets.

Contemporaneously with the development of this invention, automatic equipment has been developed to scribe and break the large substrate, after testing and marking, to form the individual cicuits, and to load the circuits from one substrate in a single file row into a temporary storage device, such as an elongated magazine.

SUMMARY OF THE INVENTION

In view of the foregoing developments, a specific object of this invention is to provide new and improved methods and apparatus for automatically storing a succession of thin film circuits as described above into good and bad circuits, based on detection of whether or not the reverse side of each substrate is marked with an ink dot, and to load the good circuits into compartments of a receiver such as a tray.

More general objects are to provide methods and apparatus for sorting a succession of articles in accordance with a detectable characteristic thereof, and to separate the articles into at least two groups based on the detected value of the characteristic.

With the foregoing and other objects in view, methods and equipment in accordance with certain features of the invention include advancing a row of articles along a chute. The leading article in the row is stopped at a test position with a releasable stop member, after which the lead article is tested for a characteristic to determine whether it is of a first type I (good circuit in the above example) or a second type II (bad circuit in the example). When type I is detected, the stop member is released so that the lead article advances further along the chute to a first receiving location. When type II is detected, an ejection mechanism is activated to eject the leading article from the chute, while still engaging the stop member, in a direction transverse to the direction of advancement of the articles along the chute.

Preferably, the second article in the row is temporarily held against further movement along the chute during the testing and sorting operations, and a leading article to be ejected is pivoted about an axis transverse to the direction of advancement of the articles, so as to disengage the trailing edge of the leading article from the leading edge of the second article, prior to the ejection stop. In one example of sorting rectangular thin film circuits, the circuits are advanced by gravity down a vertical chute, tested with a photoelectric detector to determine the presence or absence of a black mark on the circuit, and the bad circuits are ejected transversely of the chute with a piston and cylinder mechanism having a piston rod that strikes a side edge of each bad circuit so as to kick the bad circuit out of the chute.

Other objects, specific advantages and features of the invention will be apparent from the following detailed description of a specific example and embodiment thereof, when read in conjunction with accompanying drawings.

DETAILED DESCRIPTION

Figure 1:
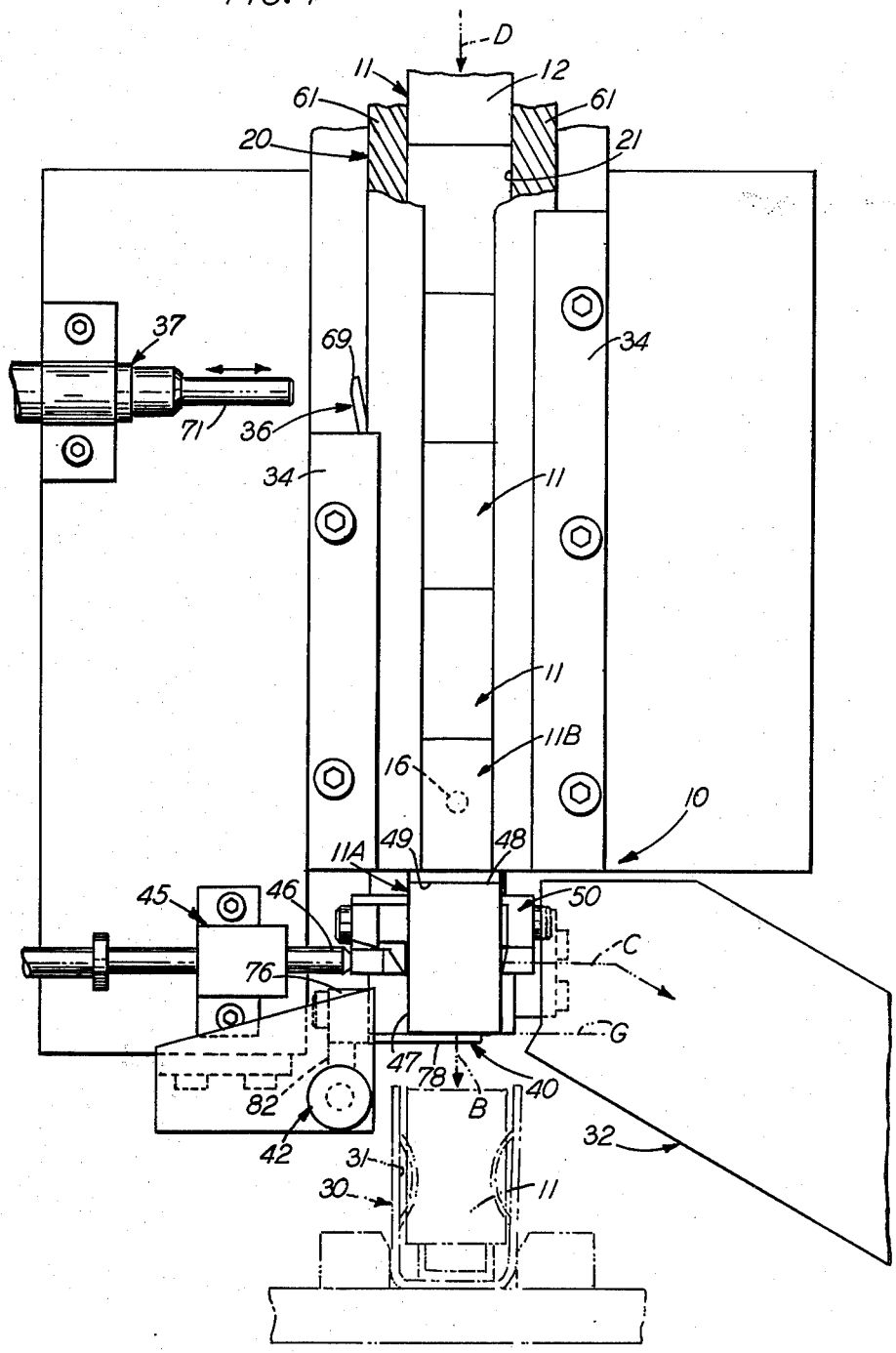
FIG. 1 is a front view of an apparatus for sorting thin film circuits in accordance with one specific embodiment of the invention.
Figure 2:
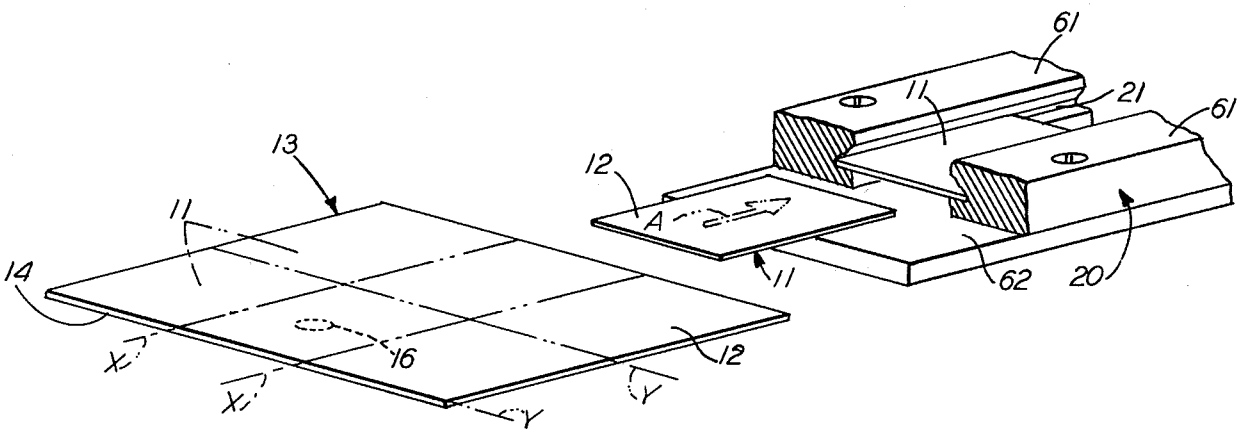
FIG. 2 is a partially schematic perspective view of a large area thin film substrate to be tested, scribed and broken to form the individual thin film circuits, and of a portion of a temporary storage device or magazine into which the circuits are loaded.

Referring now in detail to the drawings and particularly to FIGS. 1–2, there is illustrated an apparatus 10 in accordance with one specific embodiment of the invention, for sorting a succession of articles 11—11 in accordance with a characteristic thereof. In this example, the articles are thin film circuits 11 comprising thin rectangular ceramic substrates (for example 2.5 cm×1.7 cm×0.8 mm) having electrical circuit patterns deposited on a first surface 12 thereof (the top surface as viewed in FIG. 2). As is customary, a plurality of individual circuit areas are initially deposited simultaneously on a large substrate 13 (FIG. 2), such as twenty circuits per substrate in a typical example, and the individual circuit areas are then tested prior to separation into the individual circuits 11, as by scribing and breaking the large substrate 13 along orthagonal separation lines X and Y. The subtrate 13 normally also has border areas (not shown) beyond the regions where the circuits 11 are deposited, which are removed during the scribing and breaking process and discarded.

The opposite, blank surface 14 of each defective circuit 11 (the bottom surface as viewed in FIG. 2) is marked in some later-detectable way during the testing operation, such as by applying a dot 16 of black ink at a specific location on the surface 14 in this example.

After testing, scribing, and breaking, the individual circuits 11 are loaded (arrow A in FIG. 2) in a single-file row into a temporary storage device, such as an elongated magazine 20, in any conventional fashion. In this example, the magazine 20 is provided with a tapered longitudinal slot 21 for receiving a row of the circuits 11, and is sufficiently long to hold one complete array of the circuits 11 from a single one of the large substrates 13, such as a row of twenty circuits in this example. The circuits 11 may be retained in the magazine 20, as a temporary storage device, for any desired length of time, after which the magazine 20 is carried to the sorting apparatus 10 and is fastened in a vertical position to the upper portion of the apparatus 10, as illustrated in FIG. 1, where it serves as a device for feeding the circuits 11 one at a time to the sorting apparatus.

Generally, the apparatus 10 functions to test the individual circuits 11, one at a time, for a characteristic (black mark 16 or no black mark in this case), and to automatically sort the circuits into two groups (type I—good circuits, and type II—bad circuits in this example) in accordance with the detected value of the characteristic. In this example, the apparatus 10 operates to load the good circuits into a first receiver (arrow B, FIGS. 1, 3 and 4) such as an indexible receiving tray 30 having slots 31 for receiving the good circuits, and to eject the bad circuits transversely of the apparatus (arrow C, FIGS. 1 and 3), to a second receiver, such as a chute 32 for receiving defective circuits.

Figure 3:
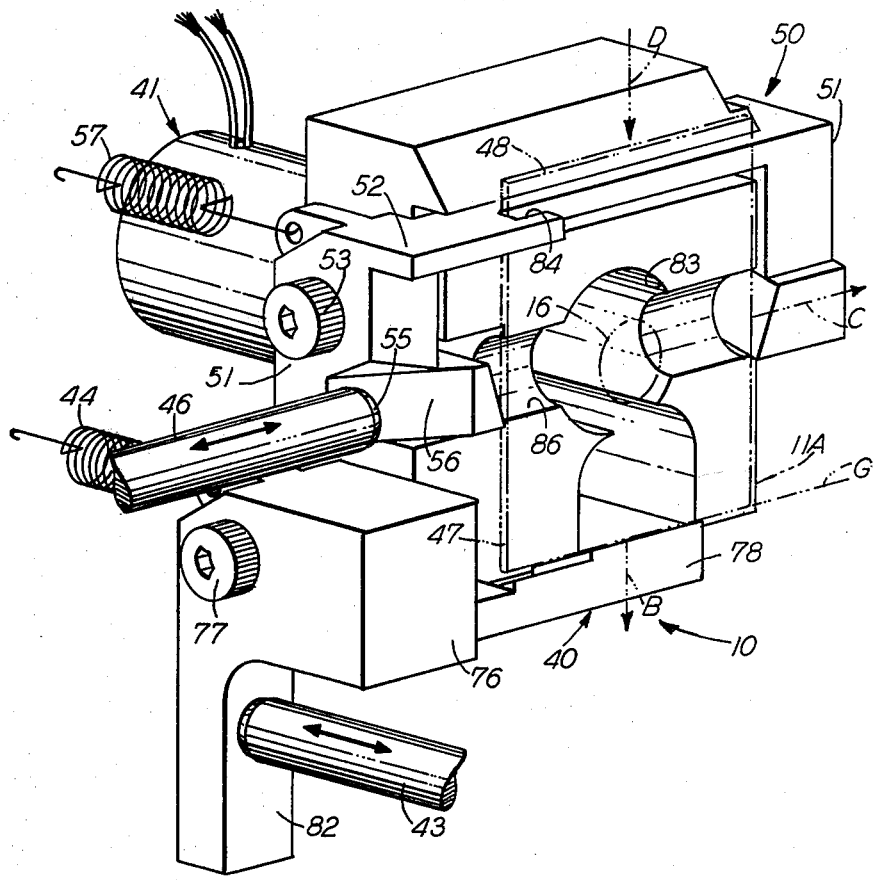
FIG. 3 is an enlarged perspective view of portions of the sorting apparatus, looking from the front and left in FIG. 1.
Figure 4:
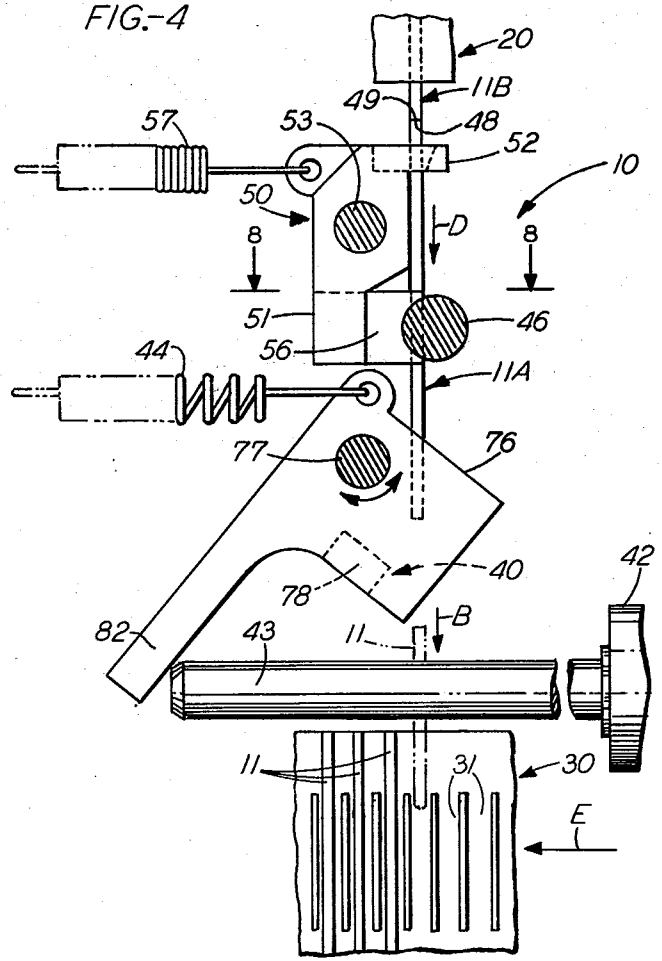
FIG. 4 is a partially schematic side view of portions of the apparatus, looking from the left in FIGS. 1 and 3, with portions of structure omitted for clarity, and illustrating the sorting of a good circuit.
Figure 6:
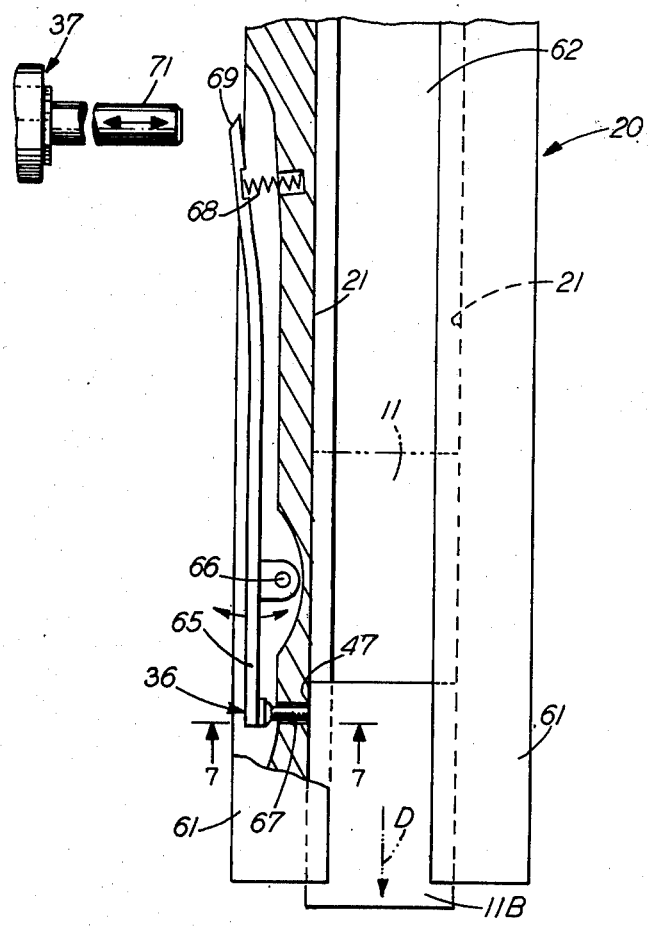
FIG. 6 is an enlarged front view of a portion of a magazine for holding and feeding the circuits, in the same position shown in FIG. 1, with portions shown in section, and illustrating details of an escapement mechanism for feeding the circuits to the sorting apparatus.
Figure 7:
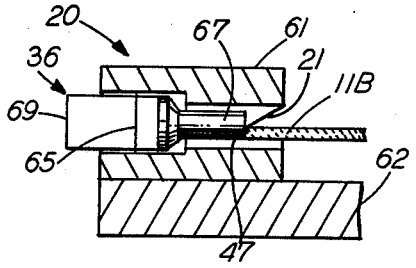
FIG. 7 is a cross section along line 7—7 of FIG. 6, illustrating further details of the magazine and escape mechanism.

Referring particularly to FIGS. 1, 3 and 4, in this embodiment of the invention, the magazine 20 is mounted vertically atop the sorting apparatus 10 by fastening the magazine in a releasable holding frame 34 of the apparatus, so that the individual circuits 11—11 may be advanced one at a time vertically downward by gravity through the apparatus 10, as indicated by arrow D. The magazine 20 is provided with a releasable detent mechanism 36 adjacent to its lower end, as illustrated in FIGS. 6–7, which normally holds the leading circuit 11 in the magazine 20 until the detent mechanism is released, as will be described in further detail hereafter.

Prior to the start of each testing operation on one of the circuits, an air cylinder 37 operates to momentarily release the detent mechanism 36 so that the leading circuit 11 in the magazine 20 drops by gravity from the magazine (arrow D) a short distance to a test position, in which the leading circuit (designated 11-A in FIGS. 1, 3 and 5) comes to a rest position supported on a releasable stop member 40, as shown in FIGS. 1 and 3. As this happens, the following circuits 11 also advance one circuit length and stack up by gravity behind the leading circuit in a vertical column. After this, the detent 36 is released so that the second circuit in the column (designated 11-B) is firmly held in the magazine 20 adjacent to the lower end thereof during the testing and sorting operations.

After the leading circuit has been advanced to the test position as shown in FIG. 3, it is tested by a conventional photoelectric detector 41, such as a S-35203 Visible Color Skanner, manufactured by The Scan-a-matic Corporation of Elbridge, New York, that detects whether or not the leading circuit has a black dot 16. If no (good circuit), an air cylinder 42 (FIG. 4) is operated, which extends a piston rod 43 to the left in FIGS. 3–4 so as to pivot the stop member 40 in a clockwise direction from the first, stop position shown in FIGS. 3 and 5 to a second, release position shown in FIG. 4, in which the stop member no longer supports the lead circuit 11-A. When this occurs, the lead circuit 11-A drops by gravity (arrow B) from the sorting apparatus into the next slot 31 of the receiving tray 30. After a good circuit has so been released, the cylinder 42 is operated to retract the rod 43, which allows a return spring 44 to pivot the stop 40 back to the stop position in preparation for the next testing operation. The tray 30 is then indexed one step to the left in FIG. 4 (arrow E), and the detent 36 is then released again to advance the next circuit 11 into the test position of FIG. 3.

Figure 8:
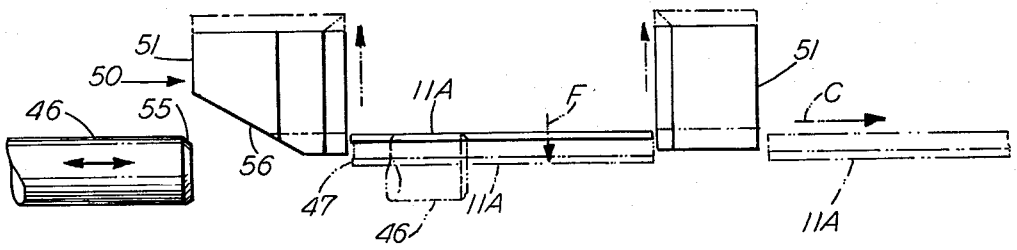
FIG. 8 is a fragmentary horizontal section along line 8—8 of FIG. 4, illustrating certain details of a mechanism for ejecting defective circuits.

If a bad circuit 11 is detected, an ejection cylinder 45 (FIG. 1) is operated, which extends a piston rod 46 to the right in FIGS. 1, 3 and 8 (into the paper in FIGS. 4 and 5) so that the front end of the rod 46 strikes a side edge 47 of the circuit 11 (the left side edge as viewed in FIGS. 1, 3 and 8), while still engaging the stop 40, with a force sufficient to eject the bad circuit transversely from the machine and into the bad parts chute 32, as indicated by arrow C. In this case, the stop member is not released.

If it were attempted to kick a bad circuit 11 out of the machine with the column of circuits 11—11 in the stacked test position shown in FIGS. 1 and 4, a relatively strong blow would be needed from the ejection cylinder 45, since the lead circuit 11-A in the test position rests by gravity on the stop 40 and a stack of up to nineteen following circuits bears by gravity on the upper edge (48) of the leading circuit 11-A. This could result in breakage of the following circuit 11-B, particularly since the substrates are made of a relatively fragile ceramic material, and also the adjacent scribed and broken edges 48 and 49 (FIG. 5, the lower edge of the following circuit 11-B) are not always 100% flat and congruent. There are often minor irregularities in contour of the adjacent contacting surfaces 48 and 49, which would impede forcible ejection of the lower circuit 11-A in the column without damage to the following circuit 11-B.

Figure 5:
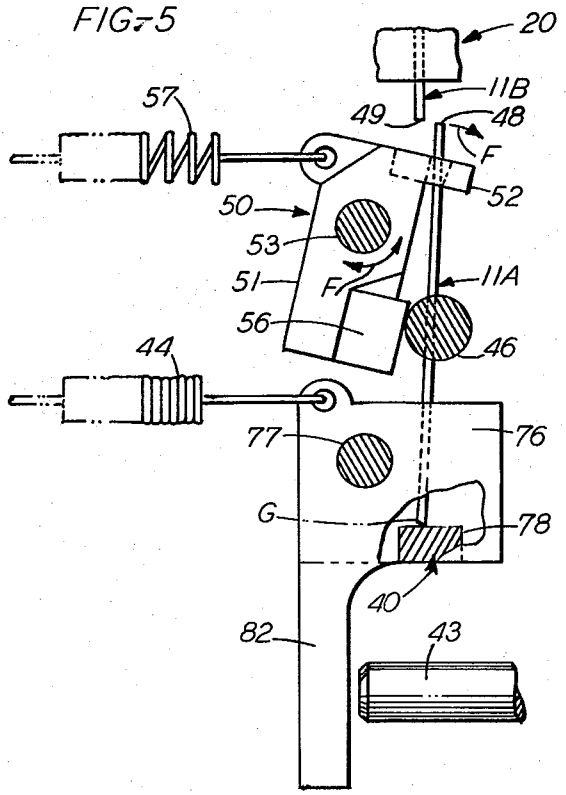
FIG. 5 is a view similar to FIG. 4, but illustrating steps in the sorting of a defective circuit.

To alleviate this difficulty, and to minimize the ejection force required, a mechanism 50 is provided for supporting and pivoting a bad circuit 11-A from the vertical test position shown in FIGS. 3 and 4 to a tilted, eject position shown in FIG. 5 (arrow F), prior to operation of the ejection cylinder 45. With this arrangement, the upper edge 48 of the bad circuit moves to a displaced position where it no longer underlies the lower edge 49 of the following circuit 11-B, as illustrated in FIG. 5, so that the bad circuit may be ejected without contacting the following circuit. Preferably, the bad circuit 11-A is pivoted about a transverse axis G (FIGS. 3 and 5) coincident with the lower edge of the circuit and perpendicular to the direction of the advancement of the circuits through the machine 10.

Referring to FIGS. 3, 4 and 5, the supporting and pivoting mechanism 50, includes a yoke 51 having an arm 52 at its upper end that bears against the left side (FIGS. 4–5) of the circuit 11 and can be pivoted (arrow F) about a horizontal rod 53 to move the yoke 51 from the FIG. 4 position to the FIG. 5 position, so as to pivot the circuit 11 a limited distance about its lower edge, which remains in contact with the stop 40, to a position clear of the following circuit 11-B. To pivot the yoke 51, the ejection piston rod 46 is preferably formed with a beveled camming surface 55 (FIG. 8) at the front end thereof, which engages a cam following surface 56 of the yoke 51 during the first part of the piston travel, to pivot the yoke 51 prior to the time that the piston 46 strikes the circuit 11 to be ejected.

After a bad circuit has been ejected, the cylinder 45 is operated to retract the rod 46 to the original position shown in FIGS. 3 and 4, following which a return spring 57 serves to pivot the yoke 51 counterclockwise in FIGS. 4–5 back to the initial position, in preparation for receiving the following circuit 11 during the next cycle. Folowing this, the magazine detent 36 is again released to drop the next circuit 11 in the column onto the stop member 40 for testing. Collectively, the magazine 20, yoke 50 and adjacent supporting structure of the sorting machine comprise a chute along which a row of the articles 11—11 is advanced through the apparatus, for testing and sorting of the articles into groups as described above.

Details of Mechanisms

Supplementing the preceding description of the basic principles of operation of the sorting apparatus 10 and methods of sorting, the following sections provide further details as to mechanisms and structural elements used in the specific embodiment of the apparatus illustrated in the drawings. Referring to FIGS. 2, 6 and 7, the magazine 20 comprises an elongated rectangular member including a pair of spaced parallel blocks 61—61 having grooved inner surfaces defining the tapered longitudinal slot 21 for receiving the row of circuits 11—11. A thin cover plate 62 is bolted along the lower face of the blocks 61, as viewed in FIG. 2, so as to fasten the blocks together in the desired spaced relationship, defining the slot 21. With this arrangement, a row of the circuits 11—11 may be inserted slidably into the slot 21 from the left as viewed in FIG. 2, and may later dropped one at a time by gravity from the lower end of the magazine when the magazine is fastened vertically atop the machine 10, as viewed in FIGS. 1 and 4.

Referring to FIGS. 6 and 7, the detent mechanism 36 for releasably holding the circuits 11 in the magazine 20 incudes a generally L-shaped lever 65 mounted in a recess formed in the left side block 61 of the magazine 20 near the lower end thereof, as viewed in FIG. 6. The lever 65 is pivoted at 66 to the side walls of the block 61 so that a lower end or tip 67 of the lever 65 may engage the left side edge 47 of the leading substrate (11-B) in the magazine, as viewed in FIGS. 6 and 7. A compression spring 68 is mounted between portions of the block 61 and the upper end (69) of the lever 65, so as to normally bias the lever 65 in a counterclockwise direction, as viewed in FIG. 6, so that the tip 67 of the lever normally forces the substrate 11-B to the right in FIG. 6, to clamp the substrate 11 between the tip 67 and the adjacent portions of the right-hand wall of the slot 21, so as to temporarily hold the leading substrate in the magazine 20 until the detent mechanism 36 is released. A similar releasable detent (not shown) is provided at the opposite end of the magazine 20 so as to hold a column of the substrates in the magazine at both ends, when the magazine functions as a temporary storage and transporting device.

To release the detent mechanism 36, the air cylinder 37 includes a reciprocable piston rod 71 arranged to be extended to the right in FIGS. 1 and 6 a distance sufficient to engage the upper end 69 of the lever 65, thus pivoting the lever 65 clockwise so as to retract the tip 67 from engagement with the substrate 11-B, after which the substrates 11—11 are free to advance downward by gravity along the magazine 20 (arrow D) until the leading substrate (11-A) is stopped in the test position by the stop 40, as previously described.

Referring to FIGS. 1, 3 and 4–5, the releasable stop member 40 includes a rectangular block 76, which is pivotably mounted on a horizontal pivot pin 77 and has a thin flat platform or shelf 78 extending from the right side of the block 76, as viewed in FIGS. 1 and 3. Normally, the block 76 is pivoted to a vertical position by the biasing spring 44, as previously mentioned, so that the shelf 78 extends horizontally to the position shown in FIGS. 1, 3 and 5, in which the shelf 78 is located directly below the lower end of the magazine 20 so as to receive and support the leading substrate 11-A, when released by the detent mechanism 36.

Preferably, the shelf 78 is positioned slightly more than the length of the one substrate 11 below the magazine 20 so that the lead substrate 11-A has a minimum distance to fall into the test position, and so that the leading edge 49 of the second substrate 11-B in the column protrudes slightly from the lower end of the magazine 20, as shown in FIGS. 4–5, but so that the major portion of the second substrate 11-B is still retained by the detent mechanism 36 in the guide slot 21 of the magazine.

When it is desired to release the stop mechanism 40 to advance a good circuit 11-A from the test position to the tray 30, the air cylinder 42 extends the piston rod 43 to the left from the FIG. 5 position to the FIG. 4 position, as previously described, at which time the free end of the rod 43 engages a depending arm 82 of the block 76 so as to pivot the block 76 counterclockwise to the FIG. 4 position, in which the shelf 78 is pivoted clear of the lower edge of the lead circuit 11-A, so that the circuit 11-A is free to drop by gravity into the next receiving slot 31 or compartment of the tray 30 (arrow B). Preferably, the tray 30 is positioned as close as possible to the stop member 40 so as to minimize the distance the circuits 11 have to fall from the stop 40 to the tray 30, so as to avoid damage to good circuits 11.

The tray 30 is indexed by any conventional mechanism in a series of steps to the left in FIG. 4 (arrow E) each time a good circuit 11 is sensed by the photoelectric detector unit 41 and dropped in the tray 30, so as to advance the next receiving slot 31 to the aligned position below the magazine 20. Since such indexing mechanisms are conventional and well known, they will not be described in detail herein.

The photoelectric detector 41 may be of any conventional design, as discussed above, and is mounted to the machine frame to the left of the yoke 51, as viewed in FIG. 3, so that it aligns with the center of the rear surface 14 of the substrate 11-A when in the test position. For this purpose, the yoke 51 is provided with a keyhole-shaped slot 83 (FIG. 3) so as to permit inspection of the surface 14 and detection of the ink dot 16 or other marking, when present.

As illustrated in FIG. 3, the upper arm 52 of the yoke 51 is formed with a rectangular slot 84 at the left side thereof, as viewed in FIG. 3, for receiving and retaining the lead circuit 11-A in the test position supported by the shelf 78 at the bottom and by the yoke arm 52 at the top, while permitting the lead circuit 11-A to be discharged from the test position either downward (arrow B) when the stop 40 pivots, or transversely (arrow C) when the ejection rod 46 is actuated.

As previously mentioned, the front face of the ejection cylinder rod 46 is formed with a beveled camming surface 55 which engages the tapered cam-following surface 56 along the left-front face (FIG. 8) of the yoke 51 so as to pivot the yoke and circuit 11-A from the solid-line position in FIG. 8 to the phantom-line position where the front face of the rod 46 strikes the side edge 47 of the tilted circuit 11-A and knocks the circuit transversely out of the machine (arrow C). For this purpose, the front face of the yoke 51 is formed with a semi-circular groove 86 (FIG. 3) slidably receiving the rod 46 during the ejection stroke.

While one specific embodiment of the invention has been described in detail above, it should be obvious that various modifications may be made from the specific details described without departing from the spirit and scope of the invention.

What is claimed is:

1. A method of sorting a succession of articles in accordance with a characteristic thereof, which comprises:

(a) advancing a row of the article along a chute;

(b) stopping the leading article in the row at a test position along the chute with a releasable stop member that engages the leading article so that the following articles in the row stack up behind the leading article;

(c) testing the leading article for the characteristic to detect whether the article is of a first type I or a second type II;

(d) if type I is detected, releasing the stop member so that the leading article advances further along the chute to a first receiving location, after which the stop member is returned to the original position where it can stop the next article in the row; and (e) if type II is detected, ejecting the leading article from the chute, while still engaging the stop member, in a direction transverse to the direction of advancement of the articles along the chute and without releasing the stop member.

2. A method as recited in claim 1, wherein the second article in the row is temporarily held against further movement along the chute during steps (c) and (d) or (e).

3. A method as recited in claim 1, wherein a type II article is ejected from the chute by exerting a force against a side edge of the of the article in the transverse direction.

4. A method as recited in any of claims 1, 2 or 3, wherein a type II article is pivoted about an axis transverse to the direction of advancement of the articles so as to disengage the trailing edge of the leading article from the leading edge of the second article, prior to step (e).

5. A method as recited in claim 4, wherein the parts are advanced by gravity vertically downward along a vertical chute.

6. A method of sorting a succession of rectangular parts in accordance with a characteristic thereof, which comprises:

(a) advancing a column of the parts by gravity down a vertical chute;

(b) stopping the leading part in the column at a test position along the chute with a releasable stop member so that the following parts in the column stack up by gravity on top of the leading part;

(c) temporarily holding the second part in the column against further downward movement along the chute;

(d) testing the leading part for the characteristic to detect whether the part is of a first type I or a second type II;

(e) if type I is detected, releasing the stop member so that the leading part advances down the chute to a first receiving location, after which the stop is returned to the original position where it can stop the next part in the column; and (f) if type II is detected, first pivoting the leading part about its lower edge so as to disengage the upper edge of the leading part from the lower edge of the following part, and then ejecting the leading part transversely from the chute by exerting a force against a side edge of the part in a direction transverse to the direction of advancement of the parts along the chute so as to direct the type II part to a second receiving location.

7. Apparatus for sorting a succession of articles in accordance with a characteristic thereof, which comprises:

a chute along which a row of the articles is advanced;

releasable means for stopping the leading article in the row at a test position along the chute, so that the leading article engages the stopping means and the following articles in the row stack up behind the leading article;

means for testing the leading article for the characteristic to detect whether the leading article is of a first type I or a second type II;

means for releasing the stopping means when a type I article has been detected so that the leading article advances further along the chute to a first receiving location; and means for ejecting a type II article from the chute, while still engaging the stopping means, in a direction transverse to the direction of advancement of the articles along the chute and without releasing the stopping means.

8. Apparatus as recited in claim 7, further comprising means for temporarily holding the second article in the row against further movement along the chute during the operation of the testing, releasing and ejecting means.

9. Apparatus as recited in claim 7, wherein the ejecting means includes a reciprocable rod for exerting a force against a side edge of the article in the transverse direction.

10. Apparatus as recited in any of claims 7, 8 or 9, further comprising means for pivoting a type II article about an axis transverse to the direction of advancement of the articles so as to disengage the the trailing edge of the leading article from the leading edge of the second article, prior to the operation of the ejecting means.

11. Apparatus as recited in claim 10, wherein the chute is arranged vertically and the parts are advanced by gravity vertically downward along the chute.

12. Apparatus sorting a succession of rectangular parts in accordance with a characteristic thereof, which comprises:

a vertical chute down which a column of the parts is advanced by gravity.

releasable means for stopping the leading part in the column in a test position along the chute so that the following parts in the column stack up by gravity on top of the leading part;

means for temporarily holding the second part in the column against further downward movement along the chute;

means for testing the leading part for the characteristic to detect whether the part is of a first type I or a second type II;

means for releasing the stopping means when a type I part has been detected so that the leading part advances further down the chute to a first receiving location, after which the stopping means is returned to the original position where it can stop the next part in the column;

means for pivoting the leading part about its lower edge when a type II part has been detected, so as to disengage the upper edge of the leading part from the lower edge of the following part; and means for ejecting the pivoted type II part transversely from the chute by exerting a force against a side edge of the part in a direction transverse to the direction of advancement of the parts along the chute so as to direct the type II part to a second receiving location.

13. Apparatus as recited in claim 12, wherein the ejecting means includes a cylinder having a reciprocable piston rod with an end surface arranged to strike the side edge of the part with sufficient force to kick a type II part out of the chute.

14. Apparatus as recited in claim 13, wherein the pivoting means is responsive to movement of the piston rod so as to pivot the part prior to the piston rod ejecting the part.

15. Apparatus as recited in claim 14, wherein the pivoting means includes a pivoted yoke having an arm engaging an upper portion of the part in the test position, wherein the piston rod is formed with a camming surface adjacent to the end surface thereof, and wherein the yoke is formed with cam-following surfaces engaged by the piston rod at the start of an ejection stroke, for pivoting the yoke to pivot the part prior to ejection thereof.

16. Apparatus as recited in any of claims 12 through 15, wherein the parts comprise electrical circuits deposited on flat insulating substitutes, wherein type I designates good circuits and type II designates defective circuits, and wherein the testing means detects the absence or presence of a mark previously placed on the circuit to indicate whether each individual circuit is good or is defective.

17. Apparatus as recited in claim 16, wherein the mark is a dot deposited on a surface of the substrate, and wherein the testing means comprises a photoelectric detector cell.

* * * * *